US006030271A

United States Patent [19]

Pietrafesa

[11] Patent Number: 6,030,271

[45] Date of Patent: Feb. 29, 2000

[54] SOFT BABY DOLL

[76] Inventor: Michael Pietrafesa, 8626 19th Ave., Brooklyn, N.Y. 11214

[21] Appl. No.: 09/087,950

[22] Filed: Jun. 1, 1998

[51] Int. Cl.[7] ..... A63H 3/06

[52] U.S. Cl. ..... 446/226; 446/268; 446/385

[58] Field of Search ..... 446/98, 220, 223, 446/226, 268, 369, 385

[56] References Cited

U.S. PATENT DOCUMENTS

| | | | |
|---|---|---|---|
| 2,503,948 | 4/1950 | Henry | 446/226 |
| 2,944,368 | 7/1960 | O'Brian et al. | 446/98 |
| 3,831,313 | 8/1974 | Cichy | 446/369 X |
| 4,055,020 | 10/1977 | Kosicki et al. | 446/221 X |
| 4,895,546 | 1/1990 | Rakonjac | 446/221 |
| 5,338,245 | 8/1994 | Murza et al. | 446/385 X |
| 5,597,339 | 1/1997 | Spector | 446/226 |
| 5,613,892 | 3/1997 | Barton | 446/226 |

FOREIGN PATENT DOCUMENTS

| | | | |
|---|---|---|---|
| 1337081 | 7/1963 | France | 446/226 |
| 912054 | 12/1962 | United Kingdom | 446/221 |

*Primary Examiner*—John A. Ricci
*Attorney, Agent, or Firm*—Michael Ebert

[57] ABSTRACT

A baby doll whose torso is defined by a fabric bag having a pair of arm openings, a pair of leg openings and a neck opening. Coupled to the arm openings and extending therefrom are hollow, flexible-plastic arms, coupled to the leg openings and extending therefrom are hollow, flexible-plastic legs, while mounted above the neck opening is a hollow, flexible-plastic head having a neck coupled to the neck opening whereby the arms, legs and head are articulated from the torso bag. Enclosed within the bag is an inflatable bladder which when inflated, erects the torso. The bag is formed of an outer fabric shell having a relatively thick inner liner formed by a layer of soft batting whereby the torso is exceptionally soft to the touch and the baby doll simulates the feel of a real baby not only in regard to the torso, but also with respect to the hollow arm and leg appendages and the head, all of which are soft and compressible. The internal air pressure within the inflated bladder is adjustable to vary the softness index of the torso.

6 Claims, 2 Drawing Sheets

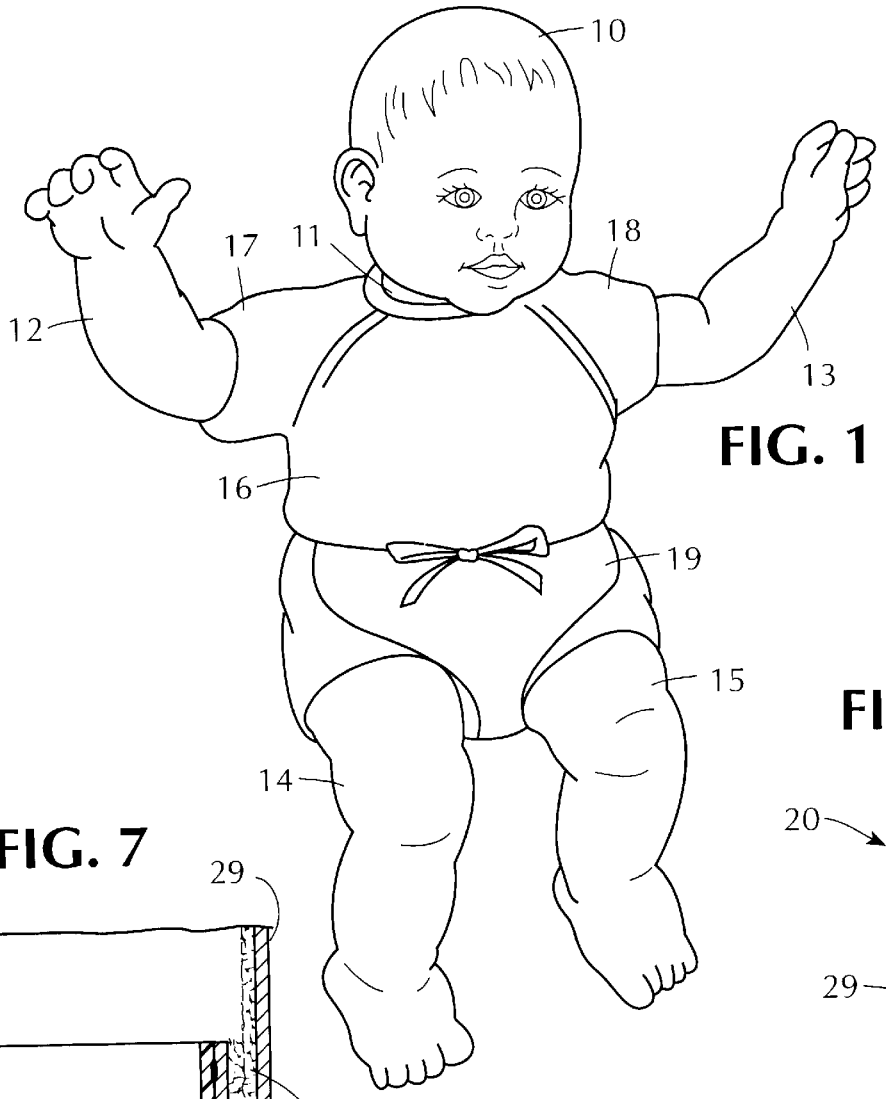
FIG. 1
FIG. 6
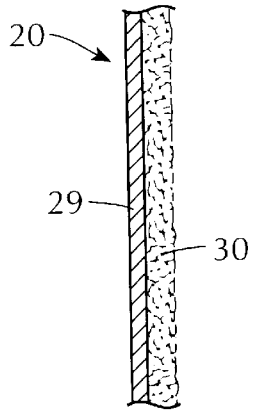
FIG. 7
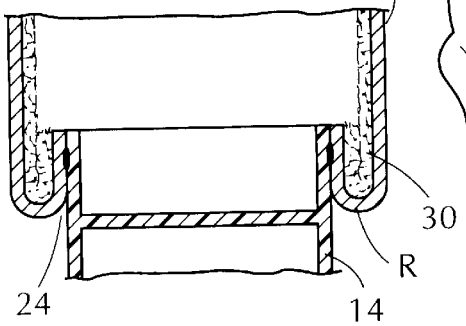
FIG. 3
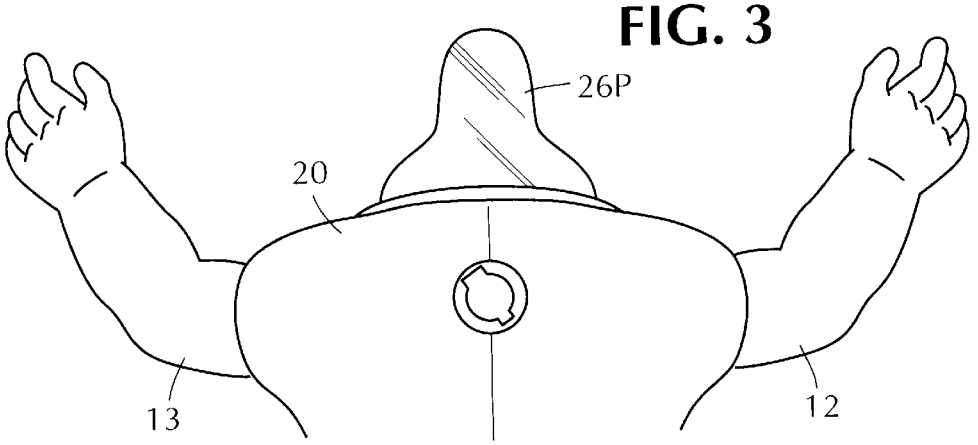

SOFT BABY DOLL

BACKGROUND OF INVENTION

1. Field of Invention

This invention relates generally to baby dolls, and more particularly to a doll having an exceptionally soft torso and soft arms and legs so that the doll has the feel of a real baby.

2. Status of Prior Art

Toy figures, such as dolls are known in which a head is joined by a neck to a torso from which extend arm and leg appendages. Toy figures are universally popular with children and represent one of the oldest type of toy in use throughout the world.

Toy figures which are especially appealing to children are stuffed figures, such as a Teddy Bear, in which a toy bear is stuffed with cotton batting and is covered with a plush fabric. Because a stuffed toy figure is soft and compressible, a child is able to hug and squeeze this figure as he would a pet.

A conventional stuffed toy figure, such as a figure resembling a Disney character, is expensive to manufacture, for the entire figure is stuffed with cotton batting or flexible foam. Since both the head and torso have a relatively large volume, the cost of the required stuffing is quite high, even though the padding requirements for the arm and leg appendages are small.

The present invention resides in a baby doll which simulates the feel of a real baby when the baby is dressed to lie in a crib, for then the apparel worn by the infant, such as a sleeveless shirt and a diaper are confined to the torso, the head and the arm and leg appendages then being bare. In order for this baby doll to have the feel of a real baby, it is necessary that the bare arms and legs be soft and that the fabric covered torso be exceptionally soft, as is true of a real baby.

Since in a baby doll in accordance with the invention, there is enclosed within a fabric bag defining the torso of the doll an inflatable bladder, of prior art interest is the 1994 patent to Spector, which shows a doll whose torso is formed by a non-stretchable fabric within which is an inflated balloon. Also of interest is the 1997 patent to Spector U.S. Pat. No. 5,597,339 which shows a monkey-like figure covered with simulated fur, a balloon being enclosed within the casing of this figure.

The 1997 patent to Barton U.S. Pat. No. 5,613,892 shows a plush Teddy Bear having an inflatable inner bladder within an outer cover. The 1950 patent to Henry U.S. Pat. No. 2,503,948 shows a baby doll having a flexible outer casing forming the torso of the baby, to which arms are pivoted. Within this casing is an inflatable bladder that expands the casing.

SUMMARY OF INVENTION

In view of the foregoing, the main object of this invention is to provide a baby doll which simulates the feel of a real baby, the arm and leg appendages of the doll being soft and the torso being exceptionally soft and yieldable.

More particularly, an object of this invention is to provide a baby doll of the above type whose torso is defined by a fabric bag having an inflatable bladder therein which when inflated erects the torso, with arm and leg appendages and a head articulated from the bag.

Also an object of this invention is to provide a baby doll which is assembled by respectively coupling to neck, leg and arm openings of a fabric bag, the neck of a hollow flexible plastic head, a pair of hollow, flexible-plastic legs and a pair of hollow, flexible-plastic arms whereby the doll may be mass-produced at low cost.

Briefly stated, these objects are attained by a baby doll whose torso is defined by a fabric bag having a pair of arm openings, a pair of leg openings and a neck opening. Coupled to the arm openings and extending therefrom are hollow, flexible-plastic arms, coupled to the leg openings and extending therefrom are hollow, flexible-plastic legs, while mounted above the neck opening is a hollow, flexible-plastic head having a neck coupled to the neck opening whereby the arms legs and head are articulated from the torso bag.

Enclosed within the bag is an inflatable bladder which when inflated, erects the torso. The bag is formed of an outer fabric shell having a relatively thick inner liner formed by a layer of soft batting whereby the torso is exceptionally soft to the touch and the baby doll simulates the feel of a real baby not only in regard to the torso, but also with respect to the hollow arm and leg appendages and the head, all of which are soft and compressible. The internal air pressure within the inflated bladder is adjustable to vary the softness index of the torso.

BRIEF DESCRIPTION OF DRAWING

For a better understanding of the invention, as well as other objects and further features thereof, reference is made to the following detailed description to be read in conjunction with the accompanying drawing, wherein:

FIG. 1 is a perspective view of a soft baby doll in accordance with the invention wearing a garment composed of a short-sleeved shirt and a panty;

FIG. 3 is a rear view of the doll;

FIG. 6 is a section taken through the fabric bag; and

FIG. 7 shows how an opening in the bag is joined to a plastic leg or arm appendage.

DETAILED DESCRIPTION OF INVENTION

Figure 4:
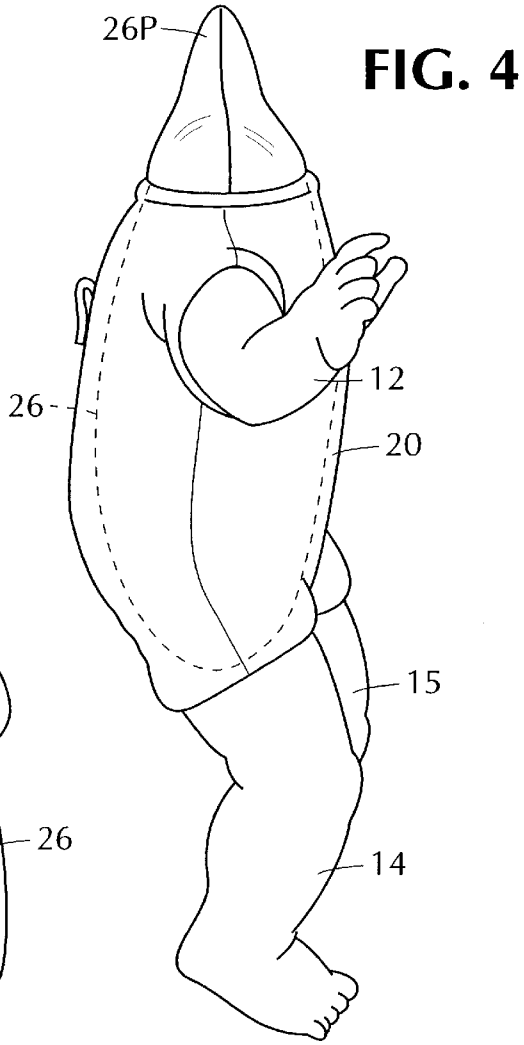
FIG. 4 is a side view of the doll.
Figure 5:
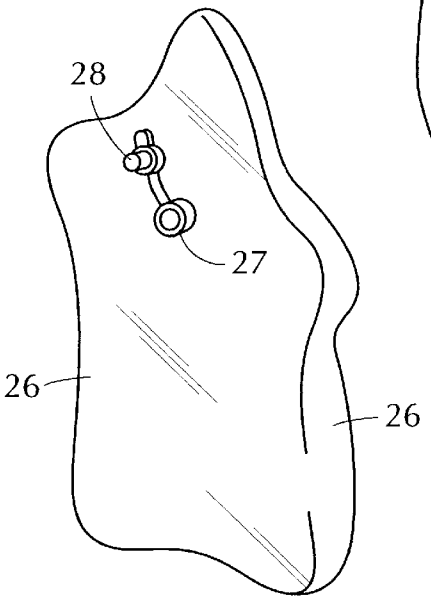
FIG. 5 separately shows the bladder which is enclosed in the fabric bag.

As shown in FIG. 1, a soft doll in accordance with the invention includes a baby head 10 having a neck 11, a pair of arms 12 and 13 terminating in hands and a pair of legs 14 and 15 terminating in feet. All of these components which resemble corresponding components in a real baby is molded of a soft, flexible plastic material, such as polyethylene or polyurethane. Because these components are all hollow, flexible and compressible, they have the feel of corresponding components in a real baby. In this baby doll, there are no hard or rigid components, and however roughly handled, there is nothing in the doll that can be fractured or broken.

The doll shown in FIG. 1 is dressed in a garment which covers the torso of the doll, the garment being composed of a fabric shirt 16 having short sleeves 17 and 18 which extend to the elbows of arms 12 and 13, and diaper-like panties 19 which almost reach the knees of legs 14 and 15. The garment illustrated is only by way of example, for the baby doll may be dressed in any manner appropriate to a baby.

Figure 2:
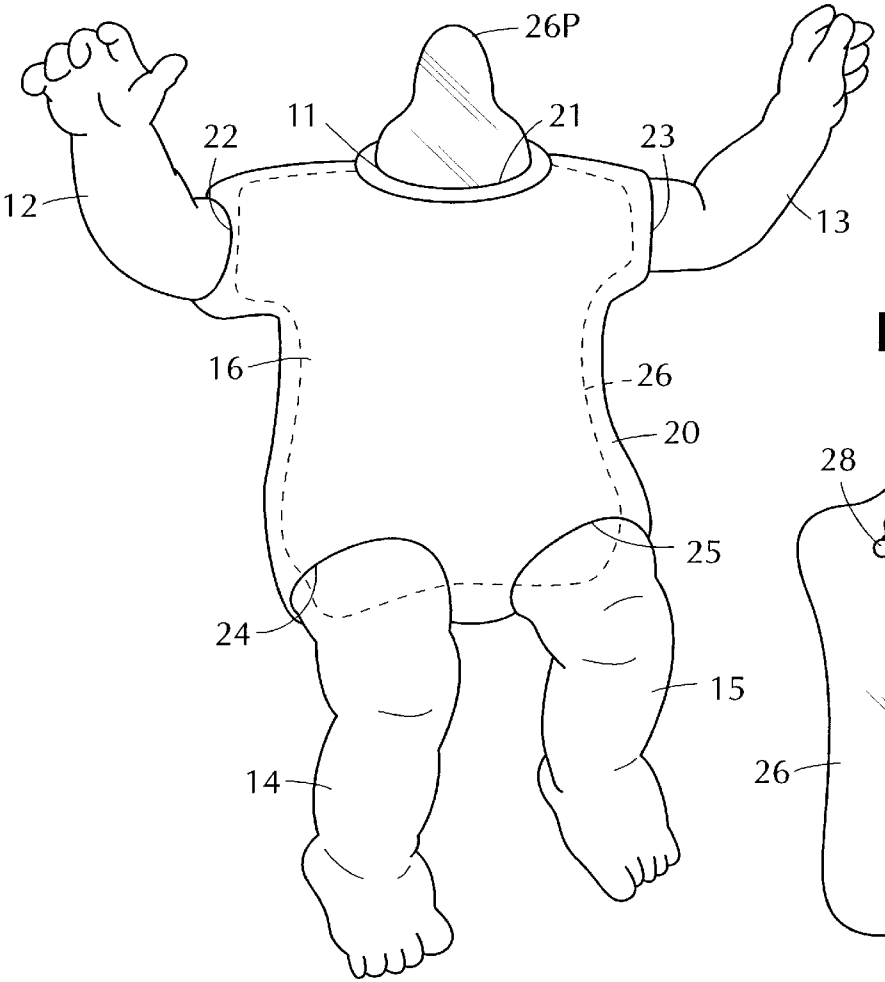
FIG. 2 illustrates the doll in front view with its head detached and its garment removed to expose the underlying fabric bag defining the torso of the doll.

Referring now to FIGS. 2, 3 and 4, the same doll is shown in these figures but with head 10 detached and the garment removed to expose the underlying torso of the doll. This torso is defined by a fabric bag 20 whose fabric construction will be later described.

Bag 20 includes at its upper end intermediate the shoulders of the torso, a circular neck opening 21 to which the neck 11 of head 10 is coupled. Bag 20 further includes at the opposing shoulders, a pair of arm openings 22 and 23 to which arms 12 and 13 are attached. And at the bottom end of the bag are leg openings 24 and 25 to which legs 14 and 15 are attached. Because bag 20 is of fabric material, the arm and leg appendages as well as the head are articulated from the bag.

Enclosed within bag 20 is a similarly-shaped inflatable bladder 26 formed of transparent flexible film material, such as polyvinyl chloride or polyethylene or polyurethane. Bladder 27 is provided with a plug extension 26P which projects upwardly through neck opening 21 into neck 11 of head 10. This plug when inflated, serves to prevent the head, which is articulated from neck opening 21, from normally leaning forward. But plug extension 26P is not essential to the invention and may be-omitted.

At the rear of bladder 26 is an inflation inlet tube 27 provided with a removable stopper 28 which when the bladder is inflated serves to seal the bladder. When one wishes to fully or partially deflate the bladder, one simply removes the stopper.

The fabric bag 20, as best seen in FIG. 6, is composed of an outer fabric, shell 29 formed of a high-strength knitted fabric and a relatively thick inner liner 30 formed by a layer of soft cotton fibers or other batting material. Hence when bladder 26 is inflated within bag 20, one who touches-the inflated bag will experience a sensation of exceptional softness. The degree of softness or firmness which represents the softness index of the torso is controllable by changing the internal pressure of the inflated bladder, either by adding more air thereto or releasing some air.

The manner in which an opening, such as leg opening 24 in the bag is formed, is shown in FIG. 7. Opening 24 is created by a circular hole in the fabric that forms the bag, the fabric at the border of the opening being folded over to create a circular rim R in which the cotton batting liner 30 is sandwiched between the fabric outer shell 29. To couple a plastic component, such as leg 14 to rim R, the rim whose inner diameter is close to the diameter of leg 14 is bonded thereto by a suitable adhesive, such as an epoxy.

There is no portion of the baby doll that is other than soft, for the head and arm and leg appendages are of hollow, flexible-plastic material. And the inflated fabric torso is exceptionally soft, because of the batting lined fabric. Because the plastic head and the leg and arm appendages are articulated from a fabric bag, these can change their positions in a life-like manner.

While there has been shown and described a preferred embodiment of a simulated soft baby doll in accordance with the invention, it will be appreciated that many changes may be made thereon within the spirit of the invention. Thus instead of batting, one can use for the same purpose as a liner for the outer fabric shell of the torso bag a flexible foam plastic material. And instead of arm and leg appendages formed of hollow, flexible plastic material, these appendages may be formed of fabric sleeves which are stuffed by compressible material and enclosed in an inflated bladder.

I claim:

1. A baby doll having a controllable softness index to simulate the feel of a real baby comprising:

A. a torso defined by a fabric bag having a pair of arm openings, a pair of leg openings and a neck opening, said torso bag being formed from an outer fabric shell having an inner liner constituted by a layer of soft batting;

B. a head having a neck mounted on said bag, the neck being coupled to the neck opening, whereby the head is articulated from the bag;

C. a pair of arms coupled to the arm openings and extending therefrom, said arms being articulated from the bag;

D. a pair of legs coupled to the leg opening and extending therefrom, said legs being articulated from the bag; and E. an inflatable bladder enclosed within the bag which when inflated applies pressure to the inner liner and erects the torso, said bladder when inflated having an internal pressure that is controllable to adjust the softness index of the baby doll to conform to that of the real baby.

2. A baby doll as set forth in claim 1, in which the arm and leg appendages are hollow and are molded of soft flexible plastic material.

3. A baby doll as set forth in claim 1, in which the head is hollow and is molded of soft flexible plastic material.

4. A baby doll as set forth in claim 3, in which the plastic is polyurethane.

5. A baby doll as set forth in claim 1, in which the batting is formed of cotton fibers.

6. A baby doll as set forth in claim 1, in which the bladder is provided at an upper end with a plug extension that extends through the neck opening and into the neck of the head to maintain the position of the head.

* * * * *